United States Patent [19]

Akashi

[11] Patent Number: 5,040,784

[45] Date of Patent: Aug. 20, 1991

[54] PAPER PRESSING DEVICE FOR AN IMAGE FORMING APPARATUS

[75] Inventor: Masakatsu Akashi, Yawata, Japan

[73] Assignee: Mita Industrial Co., Ltd., Osaka, Japan

[21] Appl. No.: 458,470

[22] Filed: Dec. 28, 1989

[30] Foreign Application Priority Data

Jan. 13, 1989 [JP] Japan ..... 1-6583

[51] Int. Cl.[5] ..... B65H 39/10

[52] U.S. Cl. ..... 271/303; 271/220; 271/3.1

[58] Field of Search ..... 271/3.1, 291, 301, 220, 271/223, 303, 902

[56] References Cited

U.S. PATENT DOCUMENTS

| | | | |
|---|---|---|---|
| 2,991,999 | 7/1961 | Doerner | 271/220 |
| 3,900,192 | 8/1975 | Gibson | 271/3.1 |
| 3,957,264 | 5/1986 | Bach et al. | 271/173 |
| 4,223,885 | 9/1980 | Templeton | 271/220 |
| 4,905,053 | 2/1990 | Matsuo et al. | 271/3.1 X |
| 4,928,151 | 5/1990 | Saeki | 271/3.1 X |

FOREIGN PATENT DOCUMENTS

| | | | |
|---|---|---|---|
| 0301598A2 | 2/1989 | European Pat. Off. . | |
| 3420328C2 | 3/1987 | Fed. Rep. of Germany . | |
| 0090334 | 6/1982 | Japan | 271/3.1 |
| 0232367 | 11/1985 | Japan | 271/220 |
| 0037655 | 2/1986 | Japan | 271/220 |
| 0166463 | 7/1986 | Japan | 271/220 |
| 2215313 | 9/1989 | United Kingdom | 271/220 |

*Primary Examiner*—Robert P. Olszewski
*Assistant Examiner*—James R. Bidwell
*Attorney, Agent, or Firm*—Jordan and Hamburg

[57] ABSTRACT

A paper pressing device for an image forming apparatus including an intermediate tray for temporarily holding a sheet of copy paper in the course of conveying the sheet of copy paper from a discharging side of the image forming apparatus to a feeding side of the image forming apparatus, a conveying path changer pivotably provided above the intermediate tray for changeably providing a first position of permitting a sheet of copy paper smaller than a predetermined size to move over the conveying path changer, and a second position of permitting a sheet of copy paper larger than the predetermined size to move under the conveying path changer, a pressing device attached to the conveying path changer and made of resilient material, the pressing means being pressable on a surface of the intermediate tray when the conveying path changer is set in the second position.

5 Claims, 5 Drawing Sheets

PAPER PRESSING DEVICE FOR AN IMAGE FORMING APPARATUS

BACKGROUND OF THE INVENTION AND RELATED ART STATEMENT

This invention relates to a paper pressing device for preventing warp of copy paper to be conveyed into an intermediate tray of an image forming apparatus, such as a copying machine.

In such a copying machine as both-side copyable copying machine and image-compositable copying machine, in which an image forming process is practiced to the same sheet of copy paper twice or more, after being passed through a fixing device, the copy paper is conveyed into an intermediate tray. The copy paper is temporarily kept in the intermediate tray and then conveyed again to an image forming position. When being passed through the fixing device, the copy paper is heated to one side thereof. Also, when being conveyed into the intermediate tray, the copy paper is bent in a large curvature, then causing a forward end poriton of the copy paper to warp upwards. Consequently, the copy paper is likely to jam in a copying mahcine. There has been needed a paper pressing device for preventing copy paper from warping.

FIG. 4 shows a conventional paper pressing device. Indicated at 81, 82, and 83 are pairs of conveying rollers for conveying copy paper to an intermediate tray 80. Between the two pairs of rollers 81 and 82 is a conveying path changer 85 pivotable about a horizontal shaft 84. When a small sheet of copy paper is conveyed, the conveying path changer 85 is set at a position illustrated by solid lines so that the copy paper is conveyed from the pair of conveying rollers 81 to the pair of conveying rollers 82 disposed in the downstream. When a large sheet of copy paper is conveyed, the conveying path changer 85 is set at another position illustrated by imaginary lines so that the copy paper is conveyed from the underside of the conveying path changer 85 directly onto the intermediate tray 80 as shown an arrow in FIG. 4.

A paper guide plate 86 is disposed in the downstream of the pair of conveying rollers 83. A pressing member 87 which is in the form of a strip and made of resilient material is disposed under the paper guide plate 86. An upper end poriton of the pressing member 87 is fixed on the underside of the paper guide plate 86 and a lower end portion of the pressing member 87 is pressed on an upper surface of the intermediate tray 80. The pressing member 87 is disposed in such a way that the lower portion of the pressing member 87 can press down an upward-warped forward end portion of a sheet of copy paper conveyed from the pairs of conveying roller 81, 83. After being passed through the pressing member 87, the copy paper is conveyed to a refeeding device 88, and conveyed to the image forming position again.

In the conventional device having the conveying path changer 85, the pressing member 87 can effectively press the upward-warped forward end portion of a small sheet of copy paper conveyed form the pair of conveying rollers 83. However, a large sheet of copy paper is conveyed directly onto the intermediate tray 80. Accordingly, there is a considerable distance between the pair of conveying rollers 81 and the pressing member 87. It could be seen that the forward end portion of the large sheet is likely to greatly warp upward before reaching the pressing member 87 as illustrated by an imaginary line P, and the pressing member 87 is likely to hinder the warped forward end portion of the large sheet to cause jamming.

SUMMARY OF THE INVENTION

It is an object of the present invention to provide a paper pressing device for an image forming apparatus which makes it possible to effectively prevent any size sheet of copy paper conveyed to an intermediate tray from warping, and eliminate jamming.

A paper pressing device for an image forming apparatus of the present invention comprising an intermediate tray for temporarily holding a sheet of copy paper in course of conveying the sheet of copy paper from a discharging side of the image forming apparatus to a feeding side of the image forming apparatus, a conveying path changer pivotably provided above said intermediate tray for changeably providing a first position of permitting a sheet of copy paper smaller than a predetermined size to move over said conveying path changer, and a second position of permitting a sheet of copy paper larger than the predetermined size to move under said conveying path changer, and pressing means attached to said conveying path changer and made of resilient material, said pressing means being pressable on a surface of said intermediate tray when said conveying path changer is set in the second position.

Also, the pressing means includes two pressing members being spaced from each other in a crosswise direction of the conveying path at a distance greater than a width of a sheet of copy paper of the predetermined size.

Further, the pressing means includes a single pressing member having a cut-away portion in a lower intermediate portion thereof, the width of the cut-away portion being greater than a width of a sheet of copy paper of the predetermined size.

Moreover, the pressing means is fixed on the underside of the conveying path changer.

Accordingly, the paper pressing device of the present invention can effectively prevent any size sheet of copy paper conveyed to an intermediate tray from warping, and eliminate jamming.

Also, the pressing means which includes two pressing members being spaced from each other in a crosswise direction of the conveying path at a distance greater than a width of sheet of copy paper of the predetermined size can prevent a sheet of copy paper smaller than the predetermined size, being conveyed to the intermediate tray after passed over the conveying path changer, from coming into contact with the pressing members.

Similarly, the pressing means which includes a single pressing member having a cut-away portion in a lower intermediate portion thereof can prevent a sheet of copy paper smaller than the predetermined size from coming into contact with the pressing member.

Furthermore, the pressing means which is fixed on the underside of the conveying path changer is made in soft contact with the intermediate tray when the conveying path changer is set at the first position. Accordingly, there is not a likelihood that the pressing means is premanently deformed.

These and others objects, features and advantages of the present invention will become more apparent upon a reading of the following detailed description and drawings.

DETAILED DESCTIPTION OF A PREFERRED EMBODIMENT OF THE PRESENT INVENTION

Figure 3:
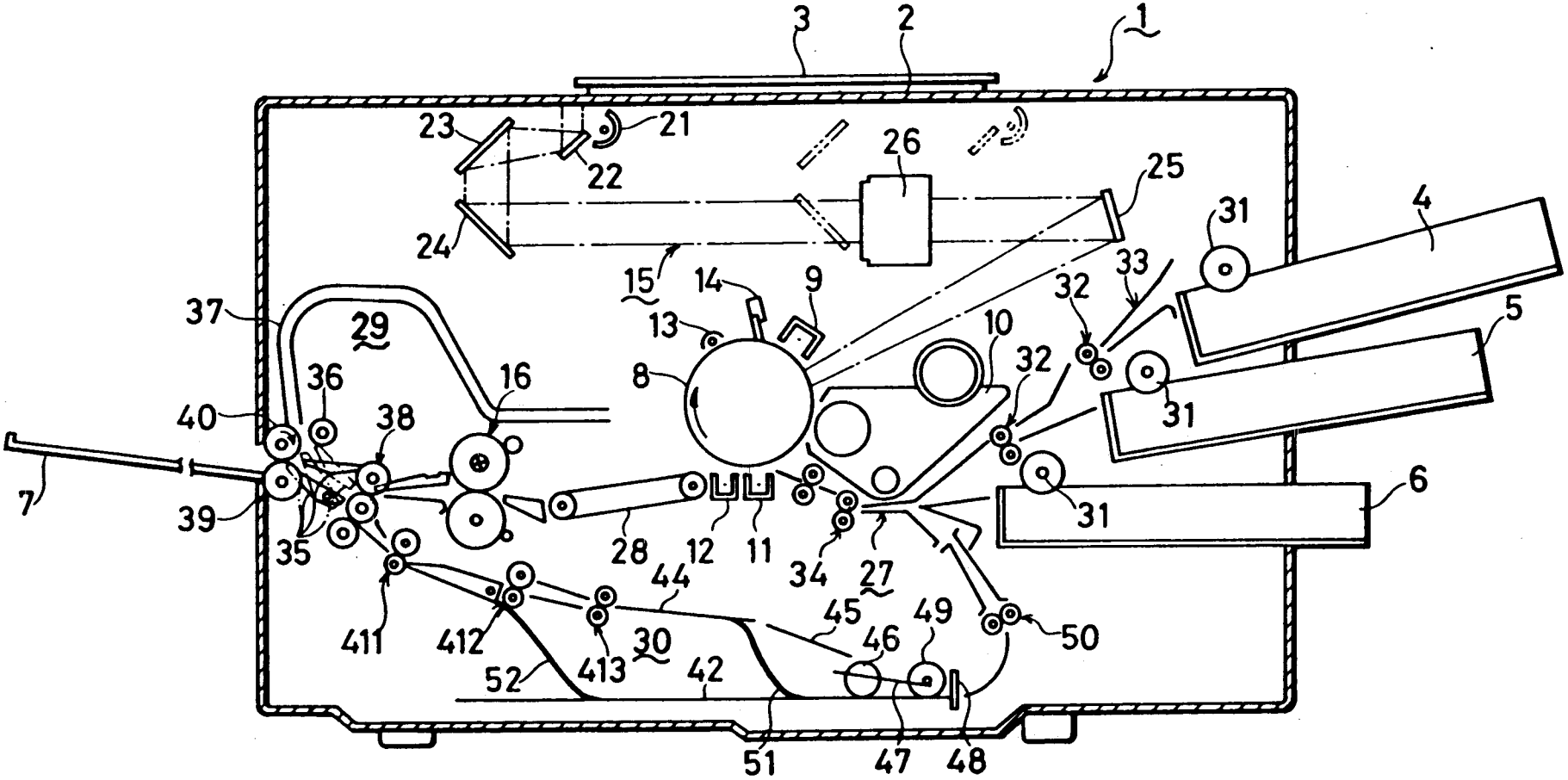
FIG. 3 is a schematic diamgram showing a whole construction of a copying machine provided with the paper pressing device.
Figure 4:
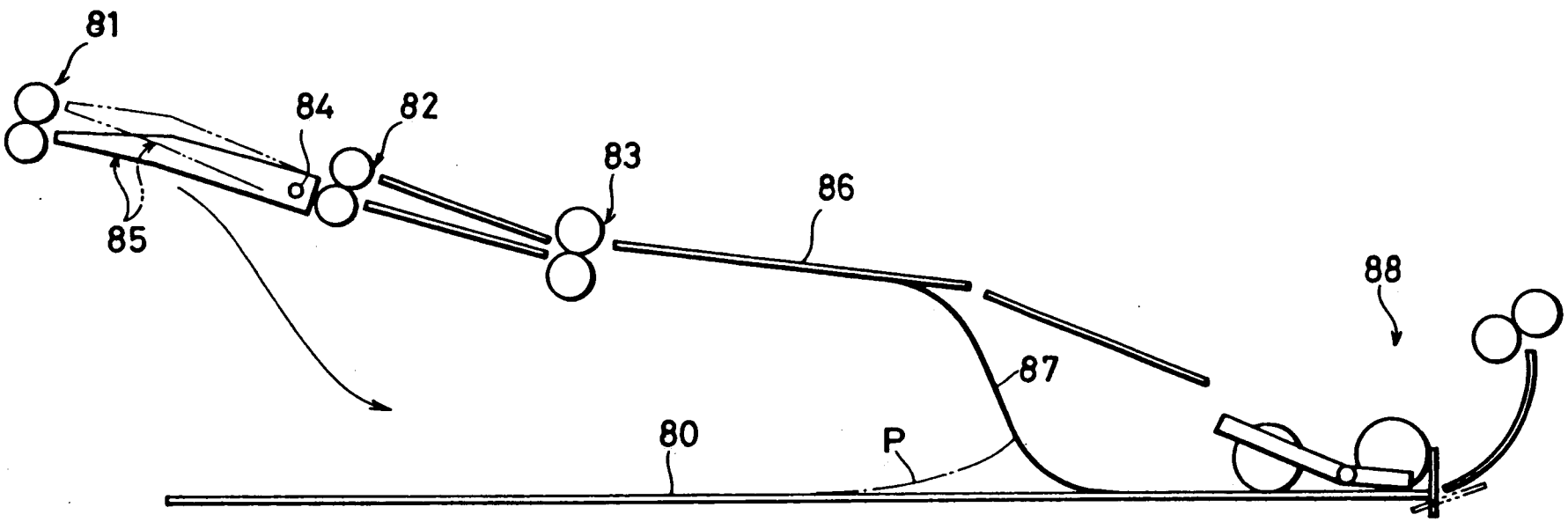
FIG. 4 PRIOR ART
FIG. 4 is a side view of a conventional paper pressing device.

FIG. 3 shows a construciton of a both-side copying machine 1 (or an image forming apparatus) provided with a paper pressing device of the present invention. The copying machine 1 has a glass plate 2 and a document presser 3 in an upper portion thereof. Paper feeder cassettes 4, 5, 6 are provided in one side of the copying machine 1. A discharge tray 7 is provided in the other side. The copying machine 1 includes a photosensitive drum 8, a main charger 9, a developing device 10, a transferring device 11, a separating device 12, a discharging device 13, a cleaning device 14, an optical system 15, and a fixing device 16, which constitute image forming means. The optical system 15 includes an exposure lamp 21, mirrors 22, 23, 24, 25, and a lens 26. A part of the optical system 15 is reciprocatingly moved to scan a document placed on the glass plate 2. The fixing devcie 16 heats copy paper carrying a transferred toner image to fix the toner image on the copy paper.

Paper conveying means of the copying machine 1 includes a paper feeding mechanism 27, a conveying belt 28, a changing mechanism 29, and a reverse feeding mechanism 30.

The paper feeding mechanism 27 includes feeding rollers 31 respectively disposed in the paper feeder cassettes 4, 5, 6, a plurality of pairs of conveying rollers 32, guide plates 33, and pairs of timing rollers 34. The paper feeding mechanism 27 feeds copy paper to the photosensitive drum 8 at a predetermined timing.

The changing mechanism 29 includes a path changer 35, a reverse feeding rollers 36, and a reversing passage means 37. The changing mechanism 29 provides two pathes by the path changer 35. One is provided by the path changer 35 set at a position illustrated by solid lines, which permits copy paper to move from a pair of conveying rollers 38 to a discharging roller 39. The other is provided by the path changer 35 set at another position illustrated by imaginary lines, which permits copy paper to move from the pair of conveying rollers 38 to the reversing passage means 37, and then from the reversing passage means 37 to the reverse feeding mechanism 30.

The reverse feeding mechanism 30 is disposed between the changing mechanism 29 and the paper feeding mechanism 27, and includes three pairs of conveying rollers 411, 412, 413 and an intermediate tray 42 for temporarily holding reversed copy paper.

Figure 1:
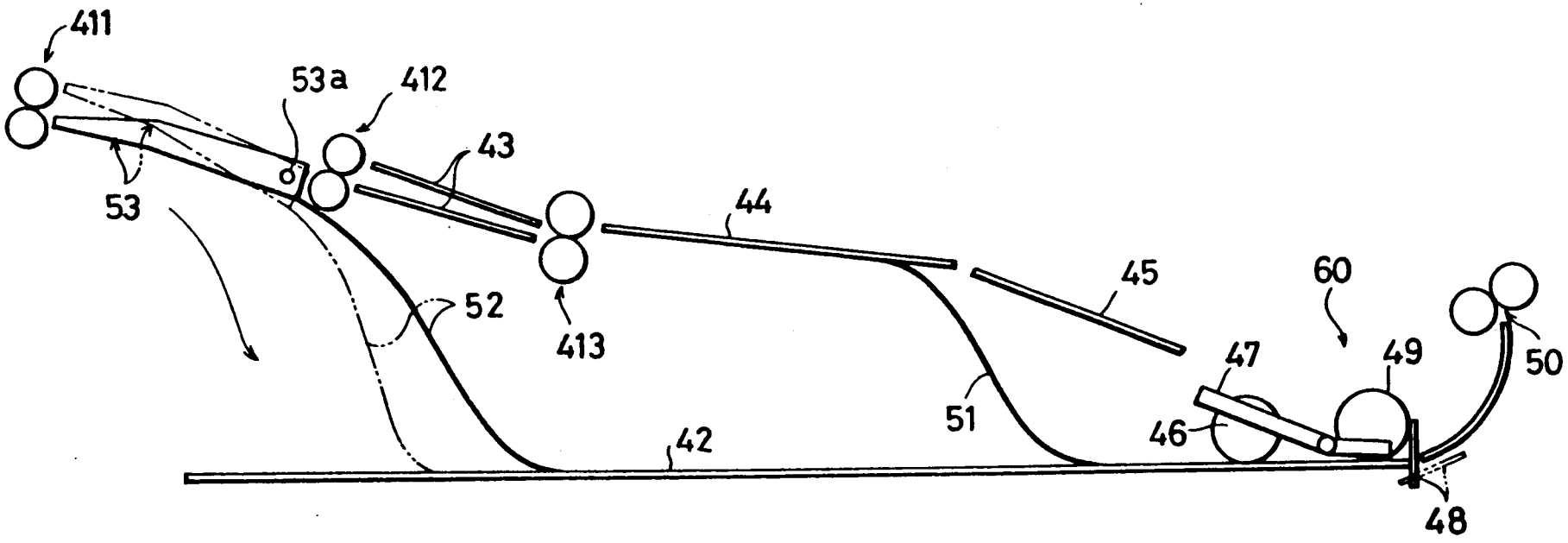
FIG. 1 is a side view of a paper pressing device embodying the present invention.

As shown in FIG. 1, guide plates 43, 44, 45 are disposed over the intermediate tray 42. A paper refeeding device 60 is provided on a downstream side portion of the intermediate tray 42. the refeeding device 60 includes a forward feeding roller 46, a pressing frame 47, a stopper 48, a refeeding roller 49, and a pair of timing rollers 50.

A conveying path changer 53 is disposed between the pair of conveying rollers 411 and the pair of conveying rollers 412. The conveying path changer 53 is pivotable about a horizontal shaft **53*a* by a solenoid or the like which is controlled by control means (not shown in the drawings). The conveying path changer 53 is set at a position illustrated by solid lines when the size of a sheet of copy paper is equal to or smaller than a predetermined sheet size, e.g., B4 international sheet size. When the size of a sheet of copy paper is greater than the predetermined sheet size or B4 size, the conveying path changer 53 is slightly pivoted counterclockwise about the horizontal shaft 53*a*** to set at another position illustrated by imaginary lines.

Figure 2A:
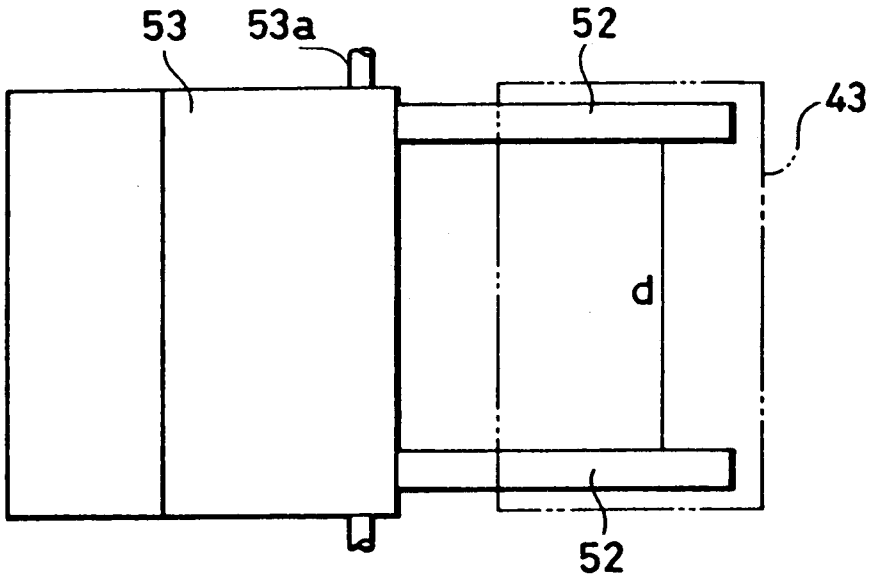
FIG. 2A is a plan view of the paper pressing device.

To underside of the guide plate 44 are attached two pressing members 51. Similarly, to underside of the conveying path changer 53 are attached two pressing members 52. The pressing members 51, 52 are disposed in a crosswise direction of the paper conveying path as shown in FIG. 2A. the pressing members 51, 52 are in the form of a strip and made of resilient material, such as polyester film. More specifically, an upper end portion of the pressing member 51 (or 52) is fixed on the underside of the guide plate 44 (or the conveying path changer 53), and a lower portion of the pressing member 51 (or 52) freely comes into contact with the intermediate tray 42. the pressing member 51 (or 52) generally inclines in a downstream direction.

The pressing member 51 has such a length that the lower portion of the presssing member 51 may come into strong contact with the intermediate tray 42. The pressing member 52 has such a length that the lower portion of the pressing member 52 may come into soft contact with the intermediate tray 42 when the conveying path changer 53 is set at the solid line position, the lower portion of the pressing member 52 may come into strong contact with the intermediate tray 42 when the conveying path changer 53 is set at the imaginary line position. The pressing members 52 are spaced from each other in the crosswise direction at a distance d. The distance d is set to be larger than the width of the predetermined sheet size or B4 size. The distance d is shown in FIG. 2A.

Next, operation of this embodiment will be described below. With the copying machine 1 set in a both-side copying mode, after being passed through the fixing device 16, a sheet of copy paper is reversed in the changing mechanism 29 and then conveyed to the pair of conveying rollers 411. The copy paper sheet is bent due to the heat of the fixing device 16 and the reversing operation of the changing mechanism 29 and a forward end portion of the copy paper sheet is consequently warped upward.

When the size of the copy paper sheet is smaller than the predetermined sheet size or B4 size, the conveying path changer 53 is set at the solid line position as shown in FIG. 1, so that the copy paper sheet is conveyed over the conveying path changer 53 to the pair of conveying rollers 412, and to the pair of conveying rollers 413, from which the copy paper sheet is then conveyed to the intermediate tray 42. The copy paper sheet immediately reaches the pressing members 51. The upward-warped forward end portion is pressed on the intermediate tray 42 by the pressing members 51 and then nipped by the forward feeding roller 46. The copy paper sheet is conveyed to the forward feeding roller 46 by the pair of conveying rollers 413. The copy paper sheet is conveyed into the paper feeding mechanism 27 by the refeeding device 60. The pair of pressing members 52 are spaced from each other at the distance d greater than the width of B4 size. Accordingly, the copy paper sheet discharged from the pair of conveying rollers 413 has no likelihood of coming into contact with the pressing members 52 to deform the pressing members 52.

When the size of the copy paper sheet is greater than the predetermined size or B4 size, the conveying path changer 53 is set at the imaginary line position as shown in FIG. 1, so that the copy paper sheet is discharged from the pair of conveying rollers 411 and passed under the conveying path changer 53 directly to the intermediate tray 42 as shown by an arrow in FIG. 1. The pressing members 52 are made in strong contact with the intermediate tray 42 due to the fact that the conveying path changer 53 is pivoted. Accordingly, the upward-warped forward end portion of the copy paper sheet is pressed on the intermediate tray 42 by the pressing members 52. The copy paper sheet is conveyed to the refeeding device 60 by the pair of conveying rollers 411 while being pressed by the pressing members 52. Specifically, the copy paper sheet is passed under the pressing members 51 and then nipped by the forward feeding roller 46. Consequently, the copy paper sheet is conveyed to the refeeding roller 49, and to the timing roller 50, and into the paper feeding mechanism 27 without jamming.

As mentioned above, in the paper pressing device, immediately after passing under the conveying path changer 53 and coming directly to the intermediate tray 42, a copy paper sheet reaches the pressing members 52. Accordingly, the upward-warped forward end portion of the copy paper sheet can be effectively pressed on the intermediate tray 42, so that jamming is prevented.

Also; the pressing members 52 comes into soft contact with the intermediate tray 42 when the conveying path changer 53 is set at the imaginary line position as shown in FIG. 1. Accordingly, the likelihood is eliminated which the lower portion of the pressing member 52 is bent upward due to a fact that the lower portion is strongly pressed on the intermediate tray 42 for a long period of time.

Figure 2B:
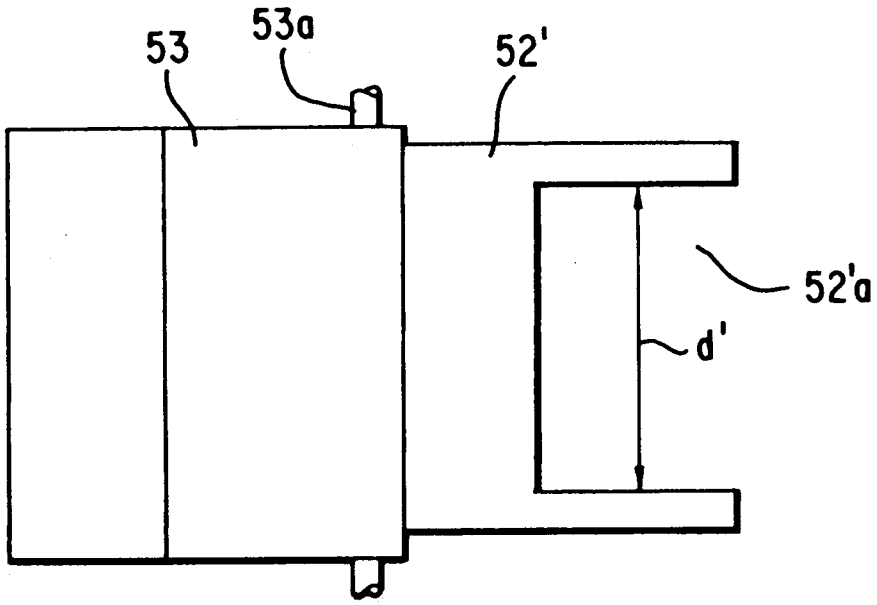
FIG. 2B is a plan view of another pressing device.

Although two pressing members 52 are attached to the conveying path changer 53 in the above embodiment, one additional pressing member or more may be attached to the conveying path changer 53. Also, the form of the pressing member is not limited in the form of a strip mentioned in the above embodiment. As shown in FIG. 2B a single pressing member 52' is applicable in the present invention which is one sheet having a cut-away portion **52'*a* in a lower intermediate portion thereof, in other words, having pressing legs on the opposite portions of the lower portion thereof. The width d' of the cut-away portion 52'*a* is greater than the width of the predetermined size or B4 size to prevent copy paper sheets discharged from the pair of conveying rollers 413 from coming into contact with this single pressing member 52'**.

Furthermore, in the present invention, a single pressing member may be attached to the conveying path changer 53 which is not formed with the above-mentioned cut-away portion although it is preferable to provide means for preventing copy paper sheets discharged from the pair of conveying rollers 413 from coming into contact with the pressing member.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included.

What is claimed is:

1. A paper pressing device for an image forming apparatus comprising:

an intermediate tray for temporarily holding a sheet of copy paper in the course of conveying the sheet of copy paper from a discharging side of the image forming apparatus to a feeding side of the image forming apparatus;

a conveying path changer pivotably provided above said intedmediate tray for changeably providing a first position of permitting a sheet of copy paper equal to or smaller than a predetermined size to move over said conveying path change, and a second postion of permitting a sheet of copy paper larger than the predetermined size to move under said conveying path changer; and pressing means attached to said conveying path changer and made of resilient material, said pressing means being pressable on a surface of said intermediate tray when said conveying path changer is set in the second position.

2. A paper pressing device according to claim 1 wherein said pressing means includes two pressing members being spaced from each other in a crosswise direction of the conveying path at a distance greater than a width of a sheet of copy paper of the predetermined size.

3. A paper pressing device according to claim 1 wherein said pressing means includes a single pressing member having a cut-away portion in a lower intermediate portion thereof, the width of the cut-away portion being greater than a width of a sheet of copy paper of the predetermined size.

4. A paper pressing device according to claim 1 wherein said pressing means is fixed on the underside of the conveying path changer.

5. A paper pressing device for an image forming apparatus comprising.

an intermediate tray for temporarily holding a sheet of copy paper in the course of conveying the sheet of copy paper from a discharging side of the image forming apparatus to a feeding side of the image forming apparatus;

a conveying path changer pivotably provided above said intermediate tray for changgeably providing a a first position of permitting a sheet of copy paper equal to or smaller than a predetermined size to move over said conveying path changer, and a second position of permitting a sheet of copy paper larger than the predetermined size to move under said conveying path changer; and pressing means made of resilient material and having two pressing portions on the opposite side portions thereof, the two pressing portions being spaced from each other in a crosswise direction of the conveying path at a distance greater than a width of a sheet of copy paper of the predetermined size, the pressing portion being adopted for guiding and pressing the copy paper sheet whose size is larger than the predetermined size onto said intermediate tray.

* * * * *